US009225113B2

(12) United States Patent
Kato et al.

(10) Patent No.: US 9,225,113 B2
(45) Date of Patent: Dec. 29, 2015

(54) CARD EDGE CONNECTOR

(75) Inventors: Rintaro Kato, Tokyo (JP); Takeshi Shindo, Tokyo (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 143 days.

(21) Appl. No.: 13/478,348

(22) Filed: May 23, 2012

(65) Prior Publication Data

US 2013/0052849 A1 Feb. 28, 2013

(30) Foreign Application Priority Data

Aug. 22, 2011 (JP) ..... 2011-180568

(51) Int. Cl.
*H01R 13/627* (2006.01)
*H01R 12/72* (2011.01)

(52) U.S. Cl.
CPC ..... *H01R 13/6275* (2013.01); *H01R 12/721* (2013.01)

(58) Field of Classification Search
CPC ..... H01R 13/6275; H01R 12/721
USPC ..... 439/326–329
See application file for complete search history.

(56) References Cited

U.S. PATENT DOCUMENTS 6,176,725 B1 * 1/2001 Kobayashi et al. ..... 439/326
6,634,899 B2 * 10/2003 Takahiro et al. ..... 439/328
6,743,028 B2 * 6/2004 Wang ..... 439/92
6,796,825 B2 * 9/2004 Wang ..... 439/326
7,494,361 B2 * 2/2009 Ho ..... 439/326
7,789,692 B2 * 9/2010 Lee ..... 439/327
7,927,120 B1 * 4/2011 Wang et al. ..... 439/328
2010/0099291 A1 4/2010 Lee
2011/0111614 A1 5/2011 Kato

FOREIGN PATENT DOCUMENTS

CN 201402874 Y 2/2010
JP 2011-100647 5/2011
JP 2011-100647 A 5/2011

OTHER PUBLICATIONS

Japanese Office Action issued in correspondence with Japanese Patent Application No. 2011-180588 with English translation of relevant portion.
Office Action issued on Jun. 12, 2014 in corresponding Chinese patent application No. 201210298513.6.

* cited by examiner

*Primary Examiner* — Briggitte R Hammond
(74) *Attorney, Agent, or Firm* — Maier & Maier, PLLC

(57) ABSTRACT

To satisfy the demand for a reduction in height, provided is a technique for reducing a gap between a motherboard and a daughterboard in the state where the daughterboard is connected to the motherboard. A card edge connector is used to be mounted on a connector mounting surface of a mainboard to connect a memory module to the mainboard. The card edge connector includes a latch portion for pressing the memory module to be displaced in a direction away from the connector mounting surface, toward the connector mounting surface. The latch portion is configured to be elastically displaceable in the direction away from the connector mounting surface.

2 Claims, 16 Drawing Sheets

Related Art

Related Art

CARD EDGE CONNECTOR

RELATED APPLICATIONS

This application claims priority under 35 U.S.C. §119 to Japanese Patent Application No. 2011-180568, filed Aug. 22, 2011, the disclosure of which is incorporated by reference herein its entirety.

BACKGROUND OF THE INVENTION

1. Field of the Invention

The present invention relates to a card edge connector.

2. Description of Related Art

As a technique of this type, Japanese Unexamined Patent Application Publication No. 2011-100647 discloses a card edge connector for connecting a memory module (daughterboard) to a mainboard (motherboard) of a personal computer.

Hereinafter, the configuration of a card edge connector 1 disclosed in Japanese Unexamined Patent Application Publication No. 2011-100647 will be described with reference to FIGS. 1 to 4, and the operation and problem of the card edge connector 1 will be described with reference to FIGS. 5 to 9.

(Configuration of Card Edge Connector 1: FIGS. 1 to 4)

As shown in FIG. 1, the card edge connector 1 is configured to connect a memory module 2 (daughterboard) to a mainboard 22 (motherboard) on which the card edge connector 1 is mounted.

The memory module 2 is composed of a PCB 3 (Printed Circuit Board) and a plurality of semiconductor packages 4 arranged on both surfaces of the PCB 3. The PCB 3 is formed in a rectangular shape having a contact edge 5 and a pair of side edges 6. The contact edge 5 has a plurality of terminals. Each side edge 6 has a semicircular notch 7.

As shown in FIGS. 1 to 3, the card edge connector 1 includes a housing 8, a plurality of upper-stage contacts 9, a plurality of lower-stage contacts 10, and a pair of arm members 11.

The housing 8 is made of a resin having insulating properties, and holds the plurality of upper-stage contacts 9 and the plurality of lower-stage contacts 10. The housing 8 is formed in an elongated shape depending on the number of terminals formed on the contact edge 5 of the memory module 2. The housing 8 is disposed on the mainboard 22 with the longitudinal direction of the housing 8 being parallel with the mainboard 22. The plurality of upper-stage contacts 9 and the plurality of lower-stage contacts 10, which are held by the housing 8, are soldered to the mainboard 22, so that the upper-stage contacts 9 and the lower-stage contacts 10 are fixed to the main board 22. As shown in FIGS. 2 and 3, the housing 8 has an insertion opening 12 for inserting the contact edge 5 of the memory module 2. When the contact edge 5 of the memory module 2 is inserted into the insertion opening 12 from an obliquely upward direction, the memory module 2 is held by the plurality of upper-stage contacts 9 and the plurality of lower-stage contacts 10 in the state of being inclined obliquely with respect to the mainboard 22.

The pair of arm members 11 is configured to maintain the depressed state of the memory module 2 when the memory module 2 is depressed toward the mainboard 22 in the state where the contact edge 5 of the memory module 2 is inserted into the insertion opening 12 of the housing 8 and the memory module 2 is obliquely held. As shown in FIGS. 2 and 3, the pair of arm members 11 is formed in an elongated shape such that the arm members 11 are orthogonal to the longitudinal direction of the housing 8 from the ends in the longitudinal direction of the housing 8 and are in parallel with the mainboard 22. As shown in FIG. 1, the pair of arm members 11 has a symmetrical shape with respect to the memory module 2. Each arm member 11 is formed by folding a single metal sheet.

The terms "housing direction", "arm direction", and "mainboard orthogonal direction" are herein defined. The "housing direction", "arm direction", and "mainboard orthogonal direction" are orthogonal to each other.

The term "housing direction" refers to the longitudinal direction of the housing 8 as shown in FIGS. 1 to 3. In the "housing direction", a direction from each end in the longitudinal direction of the housing 8 toward the central portion in the longitudinal direction of the housing 8 is referred to as "housing center direction", and a direction from the central portion in the longitudinal direction of the housing 8 toward each end in the longitudinal direction of the housing 8 is referred to as "housing anti-center direction".

The term "arm direction" refers to the longitudinal direction of the arm members 11 as shown in FIGS. 1 to 3. In the "arm direction", a direction from each proximal end (each end on the housing 8 side) in the longitudinal direction of the arm members 11 toward each distal end in the longitudinal direction of the arm members 11 is referred to as "arm distal end direction", and a direction from each distal end in the longitudinal direction of the arm members 11 toward each proximal end in the longitudinal direction of the arm members 11 is referred to as "arm proximal end direction".

The term "mainboard orthogonal direction" refers to the direction orthogonal to the mainboard 22. In the "mainboard orthogonal direction", a direction approaching the mainboard 22 is referred to as "mainboard approaching direction", and a direction away from the mainboard 22 is referred to as "mainboard separating direction".

Referring next to FIG. 4, the arm members 11 will be described in detail. As described above, the pair of arm members 11 has a symmetrical shape with respect to the memory module 2. Only the arm member 11 illustrated in the state of being dismounted from the housing 8 in FIG. 3 will be described below, and the description of the other arm member 11 will be omitted.

As shown in FIG. 4, the arm member 11 is mainly composed of a fixing portion 13, a spring portion 14, and a press-fitting portion 15. The fixing portion 13 has an SMT portion 16 (Surface Mount Tab). The spring portion 14 has a latch portion 17, an interference portion 18, and a regulation portion 19.

Each of the fixing portion 13, the spring portion 14, and the press-fitting portion 15 is in such a posture that the principal plane thereof is orthogonal to the housing direction, and is formed in an elongated shape along the arm direction.

The fixing portion 13 is configured to fix the end in the arm proximal end direction of the spring portion 14 to the mainboard 22 in cooperation with the press-fitting portion 15. The SMT portion 16 of the fixing portion 13 is fixed to the mainboard 22 by soldering, for example.

The spring portion 14 is a plate spring for elastically supporting the latch portion 17 so that the latch portion 17 can be elastically displaced in a desired direction. As shown in FIG. 4, the principal plane of the spring portion 14 is in a posture orthogonal to the housing direction. Accordingly, the spring portion 14 elastically supports the latch portion 17 so that the latch portion 17 can be elastically displaced in the housing direction, when viewed along the arm direction. The spring portion 14 is disposed on the side of the housing anti-center direction when viewed from the fixing portion 13. The spring portion 14 overlaps the fixing portion 13 in the housing direction and is in parallel with the fixing portion 13. The spring portion 14 is coupled to the fixing portion 13 through a folding portion 20. Specifically, the end on the side of the arm proximal end direction of the spring portion 14 is coupled to the end on the side of the arm proximal end direction of the fixing portion 13 through the folding portion 20. Each of the latch portion 17, the interference portion 18, and the regulation portion 19 is formed at the end on the side of the arm distal end direction of the spring portion 14.

The latch portion 17 is configured to press the memory module 2, which is to be displaced toward the mainboard separating direction, toward the mainboard approaching direction. As shown in FIG. 5, the latch portion 17 includes a guide surface 17*a* (push-away surface) and a pressing portion 17*b*. The guide surface 17*a* is an inclined surface that is inclined to approach the mainboard toward the housing center direction when viewed along the arm proximal end direction. The pressing portion 17*b* is formed by being folded in the housing anti-center direction from the tip end on the side of the housing center direction of the guide surface 17*a*.

The interference portion 18 is configured to detect whether the contact edge 5 of the memory module 2 is appropriately inserted into the insertion opening 12 of the housing 8. When the contact edge 5 is not appropriately inserted into the insertion opening 12, the interference portion 18 physically interferes with the side edges 6 of the PCB 3 of the memory module 2, thereby prohibiting the memory module 2 from being depressed in the mainboard approaching direction. On the other hand, when the contact edge 5 is appropriately inserted into the insertion opening 12, the interference portion 18 is housed in the notch 7 formed in the corresponding side edge 6 of the PCB 3 of the memory module 2, thereby allowing the memory module 2 to be depressed in the mainboard approaching direction.

The regulation portion 19 is configured to regulate an excessive displacement of the interference portion 18 in the housing anti-center direction.

The press-fitting portion 15 is disposed on the side of the arm proximal end direction when viewed from the spring portion 14, and is connected to the end on the side of the arm proximal end direction of the spring portion 14. When the press-fitting portion 15 is press-fit in the arm proximal end direction into a press-fitting hole 21 (see FIG. 3) formed at each end in the housing direction of the housing 8, so that the arm member 11 is held by the housing 8. That is, the arm member 11 is supported and fixed to the mainboard 22 through the SMT portion 16 of the fixing portion 13, and is supported and fixed to the housing 8 through the press-fitting portion 15.

(Operation and Problem of Card Edge Connector 1)

Referring next to FIGS. 5 to 9, the operation and problem of the above-mentioned card edge connector 1 will be described.

In the field of laptop personal computer products, for example, with the achievement of a thinner heat sink of a CPU (Central Processing Unit), while the heat sink has the greatest height of any of the components, there is a strong demand for a reduction in height of peripheral components in units of 100 microns. For example, in the card edge connector 1 shown in FIG. 1, it is preferable that no gap be left between the memory module 2 and the mainboard 22 when the memory module 2 is mounted. However, when the card edge connector 1 shown in FIG. 1 is adopted, an unavoidable gap a is left between a connector mounting surface 22*a* of the mainboard 22 and a module bottom surface 2*a* of the memory module 2 (the bottom surface of the daughterboard) as shown in FIG. 5. The reason why the gap α is left will be described below, while explaining the operation of the card edge connector 1.

FIG. 6 shows a state where the contact edge 5 of the memory module 2 is inserted into the insertion opening 12 of the housing 8 to depress the memory module 2 toward the mainboard 22, and the side edge 6 of the PCB 3 of the memory module 2 contacts the guide surface 17*a* of the latch portion 17 of the arm member 11.

As the memory module 2 is further depressed toward the mainboard 22 from the state shown in FIG. 6, the side edge 6 slides on the guide surface 17*a* as indicated by the outline arrow in FIG. 7, and the side edge 6 pushes away the latch portion 17 in the housing anti-center direction which is a direction in parallel with the connector mounting surface 22*a*. In FIG. 7, the position before the displacement of the latch portion 17 is indicated by the dashed line for reference.

As the memory module 2 is further depressed toward the mainboard 22 from the state shown in FIG. 7, the side edge 6 further pushes away the latch portion 17 in the housing anti-center direction. Eventually, the side edge 6 overrides the latch portion 17, and as shown in FIG. 8, the module bottom surface 2*a* of the memory module 2 abuts against the connector mounting surface 22*a* of the mainboard 22.

Herein, the distance between the pressing portion 17*b* of the latch portion 17 of the arm member 11 and the connector mounting surface 22*a* of the mainboard 22 is defined as a latch gap H1. Further, the distance between a pressed surface 2*b* of the memory module 2, which is a contact portion of the latch portion 17 when the memory module 2 is pressed in the mainboard approaching direction by (the pressing portion 17*b* of) the latch portion 17, and the module bottom surface 2*a* of the memory module 2 is defined as a module thickness H2.

As shown in FIG. 8, the latch gap H1 is set to be greater than the module thickness H2, that is, H1>H2. Accordingly, in the state shown in FIG. 8, a gap β is secured between the pressing portion 17*b* of the latch portion 17 and the pressed surface 2*b* of the memory module 2. The presence of the gap β allows the latch portion 17 to be restored in the housing center direction by the self elastic restoring force of the spring portion 14 as indicated by the outline arrow, without physically interfering with the side edge 6 of the PCB 3 of the memory module 2 when the module bottom surface 2*a* of the memory module 2 abuts against the connector mounting surface 22*a* of the mainboard 22.

After that, when the depression of the memory module 2 toward the mainboard 22 is released, the memory module 2 springs up in the mainboard separating direction as indicated by the outline arrow in FIG. 9, so that the pressed surface 2*b* of the memory module 2 contacts the pressing portion 17*b*. Accordingly, a further displacement of the memory module 2 in the mainboard separating direction is regulated by the latch portion 17.

As is obvious from the comparison between FIGS. 5, 8, and 9, the reason that the gap α shown in FIG. 5 is left is the same as the reason that the gap β is present. That is, the gap α is left because the latch portion 17 is allowed to be restored without any difficulty in the housing center direction by the self elastic restoring force of the spring portion 14, without physically interfering with the side edge 6 of the PCB 3 of the memory module 2 when the module bottom surface 2*a* of the memory module 2 abuts against the connector mounting surface 22*a* of the mainboard 22 as shown in FIG. 8. In other words, the gap α is indispensable for the configuration disclosed in Japanese Unexamined Patent Application Publication No. 2011-100647.

In view of the above, in order to satisfy the demand for a further reduction in height, it is an object of the present invention to provide a technique for reducing the gap between the motherboard and the daughterboard in the state where the daughterboard (corresponding to the memory module 2) is connected to the motherboard (corresponding to the mainboard 22).

SUMMARY OF THE INVENTION

According to a first exemplary aspect of the present invention, there is provided a card edge connector used to be mounted on a connector mounting surface of a motherboard to connect a daughterboard to the motherboard, the card edge connector including: a latch portion for pressing the daughterboard to be displaced in a direction away from the connector mounting surface, toward the connector mounting surface; and a plate spring for allowing the connector mounting surface to elastically support the latch portion. The plate spring is inclined with respect to the connector mounting surface.

Preferably, the latch portion has a push-away surface for allowing the daughterboard to push away the latch portion when the daughterboard is depressed toward the connector mounting surface and contacts the push-away surface, and the plate spring is inclined with respect to the connector mounting surface such that the latch portion is elastically displaced in the direction away from the connector mounting surface when the latch portion is pushed away by the daughterboard through the push-away surface.

According to a second exemplary aspect of the present invention, there is provided a card edge connector used to be mounted on a connector mounting surface of a motherboard to connect a daughterboard to the motherboard, the card edge connector including: a latch portion for pressing the daughterboard to be displaced in a direction away from the connector mounting surface, toward the connector mounting surface. The latch portion is configured to be elastically displaceable in a direction away from the connector mounting surface.

Preferably, the latch portion has a push-away surface for allowing the daughterboard to push away the latch portion when the daughterboard is depressed toward the connector mounting surface and contacts the push-away surface, and the latch portion is configured to be elastically displaced in the direction away from the connector mounting surface when the latch portion is pushed away by the daughterboard through the push-away surface.

Preferably, the card edge connector further includes a plate spring for allowing the connector mounting surface to elastically support the latch portion. A posture of the plate spring is set to be elastically displaced in the direction away from the connector mounting surface when the latch portion is pushed away by the daughterboard through the push-away surface.

Preferably, the plate spring is inclined with respect to the connector mounting surface.

According to an exemplary aspect of the present invention, it is possible to reduce the gap between the motherboard and the daughterboard in the state where the daughterboard is connected to the motherboard, as compared to the case where the latch portion is elastically displaceable only in the direction parallel to the connector mounting surface.

The above and other objects, features and advantages of the present invention will become more fully understood from the detailed description given hereinbelow and the accompanying drawings which are given by way of illustration only, and thus are not to be considered as limiting the present invention.

Figure 1:
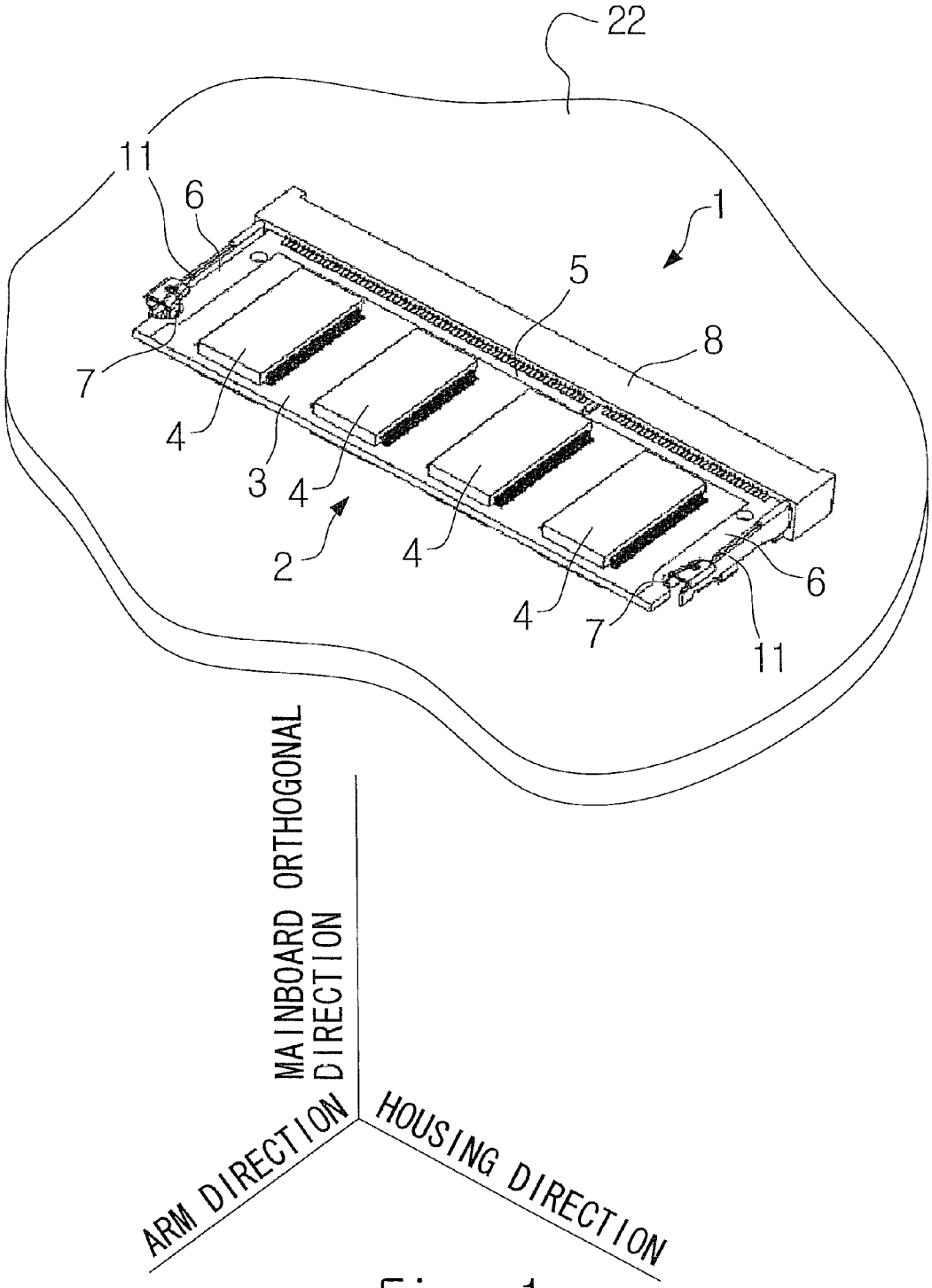
FIG. 1 is a diagram corresponding to FIG. 7 of Japanese Unexamined Patent Application Publication No. 2011-100647.
Figure 2:
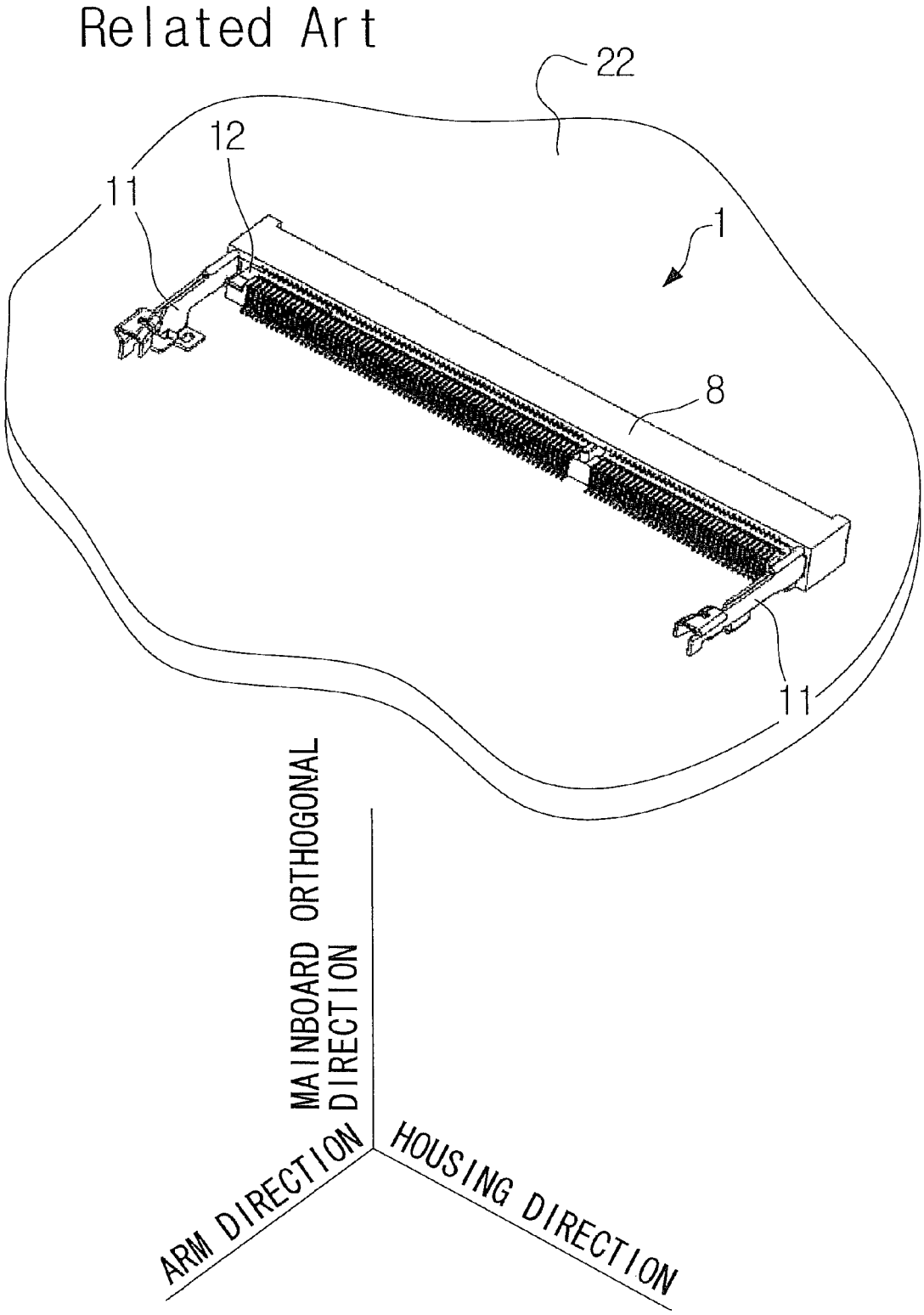
FIG. 2 is a diagram corresponding to FIG. 1 of Japanese Unexamined Patent Application Publication No. 2011-100647.

DESCRIPTION OF THE EXEMPLARY EMBODIMENTS (First Exemplary Embodiment)

Hereinafter, a first exemplary embodiment of the present invention will be described with reference to FIGS. 10 to 16. Note that differences between the card edge connector of this exemplary embodiment and the card edge connector disclosed in Japanese Unexamined Patent Application Publication No. 2011-100647 are mainly described, and a repeated explanation is omitted as needed. The components corresponding to those of the Japanese Unexamined Patent Application Publication No. 2011-100647 are denoted by the same reference numerals as a rule.

Figure 10:
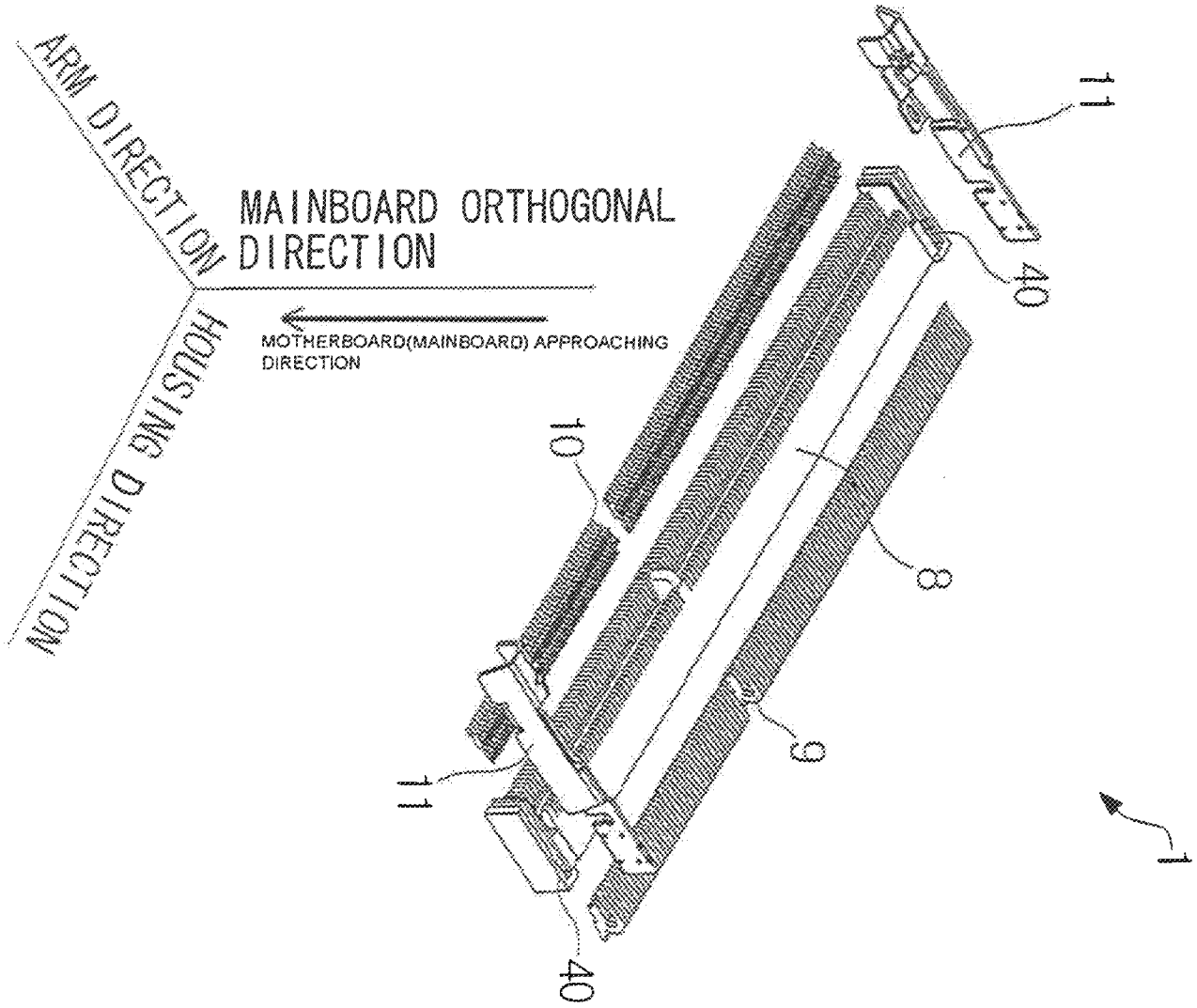
FIG. 10 is an exploded perspective view of a card edge connector (first exemplary embodiment)

As shown in FIG. 10, a card edge connector 1 includes a housing 8, a plurality of upper-stage contacts 9, a plurality of lower-stage contacts 10, and a pair of arm members 11.

Figure 11:
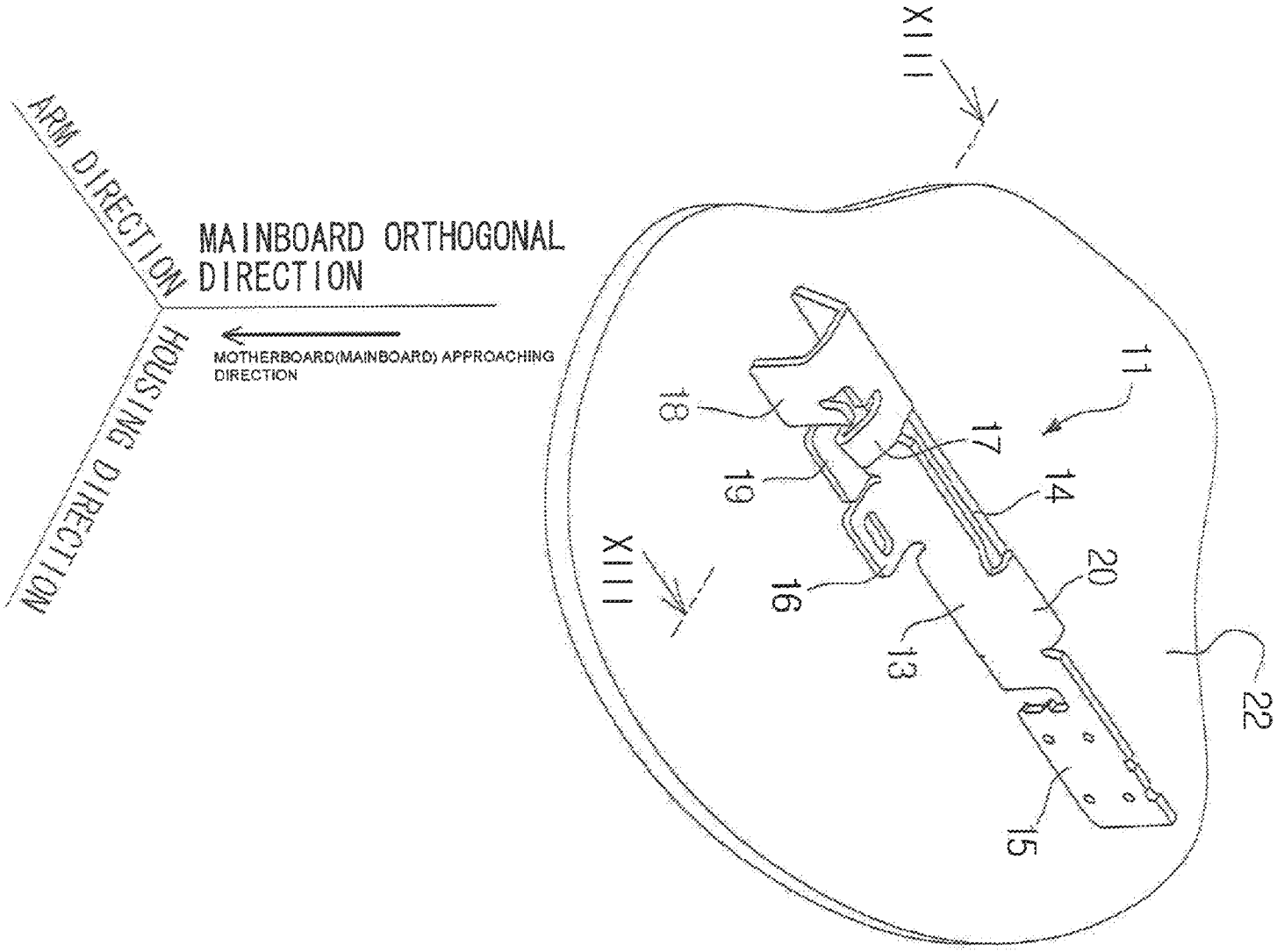
FIG. 11 is a perspective view of one arm member (first exemplary embodiment)
Figure 12:
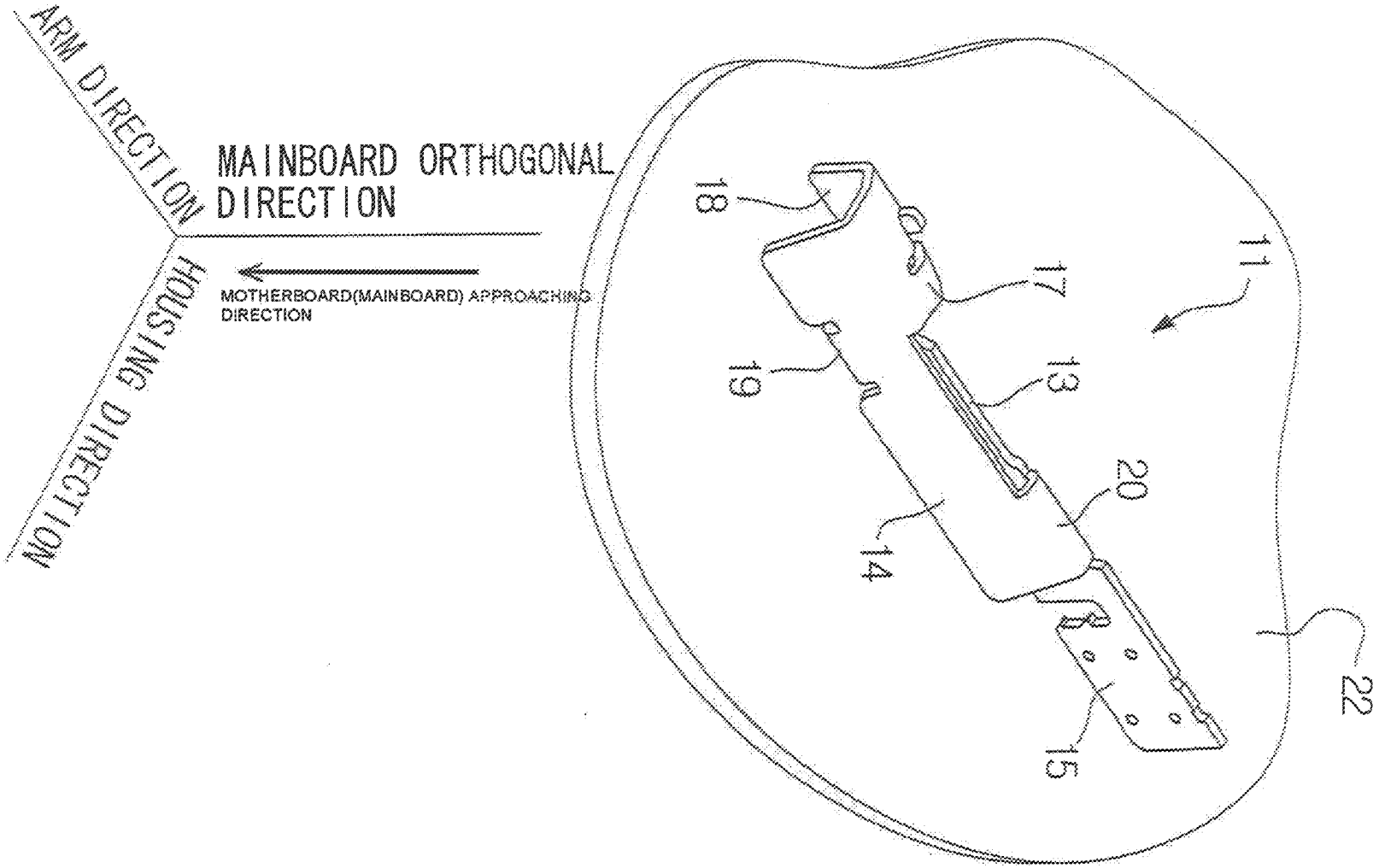
FIG. 12 is a perspective view of the other arm member (first exemplary embodiment)

As shown in FIGS. 11 and 12, each arm member 11 is mainly composed of a fixing portion 13, a spring portion 14, and a press-fitting portion 15. The fixing portion 13 has an SMT portion 16. The spring portion 14 has a latch portion 17, an interference portion 18, and a regulation portion 19.

Each of the fixing portion 13 and the press-fitting portion 15 is in such a posture that the principal plane is orthogonal to the housing direction, and is formed in an elongated shape along the arm direction. The spring portion 14 is in a posture slightly inclined with respect to the fixing portion 13 and is formed in an elongated shape along the arm direction.

The press-fitting portion 15 is disposed on the side of the arm proximal end direction when viewed from the fixing portion 13, and is connected to the end on the side of the arm proximal end direction of the fixing portion 13. The press-fitting portion 15 is press-fit in the mainboard approaching direction into a press-fitting hole 40 (see FIG. 10) formed at each end in the housing direction of the housing 8, so that the arm member 11 is held by the housing 8. That is, the arm member 11 is supported and fixed to the mainboard 22 through the SMT portion 16 of the fixing portion 13, and is supported and fixed to the housing 8 through the press-fitting hole 40.

Figure 13:
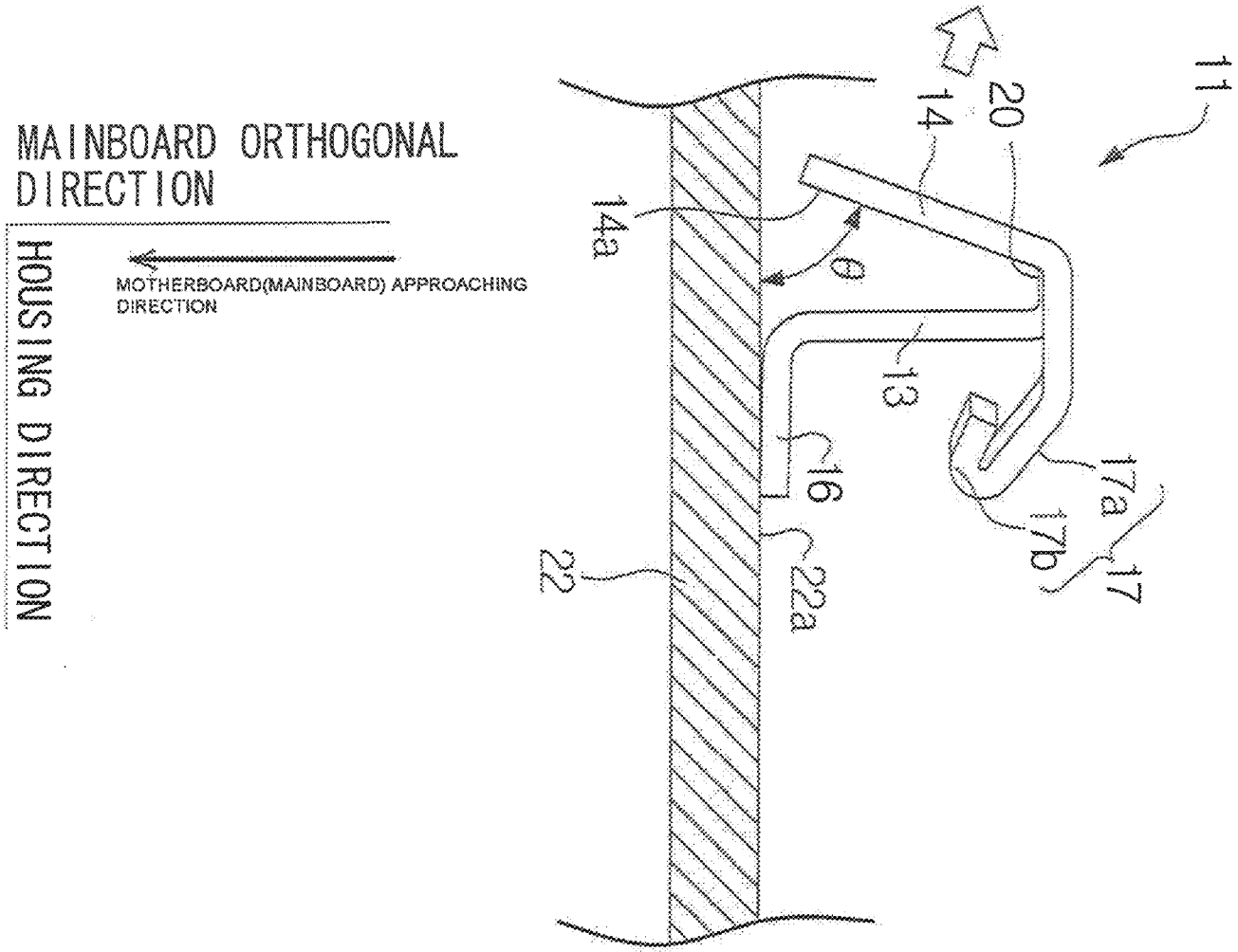
FIG. 13 is a sectional view taken along the line XIII-XIII in FIG. 11 (first exemplary embodiment)

The spring portion 14 is a plate spring for elastically supporting the latch portion 17 so that the latch portion 17 can be elastically displaced in a desired direction. As shown in FIG. 13, the spring portion 14 is in a posture inclined in the housing anti-center direction toward the mainboard approaching direction. Accordingly, the spring portion 14 elastically supports the latch portion 17 so that the latch portion 17 can be elastically displaced in the direction in which the latch portion 17 is spaced apart from the mainboard 22 in accordance with the displacement in the housing anti-center direction and approaches the mainboard 22 in accordance with the displacement in the housing center direction, when viewed along the arm direction. The spring portion 14 is disposed on the side of the housing anti-center direction when viewed from the fixing portion 13. The spring portion 14 overlaps the fixing portion 13 in the housing direction, and is inclined by about 70 degrees with respect to a connector mounting surface 22*a* of the mainboard 22. That is, $\theta \approx 70$ degrees is set in FIG. 13.

(Operation of Card Edge Connector 1)

Figure 14:
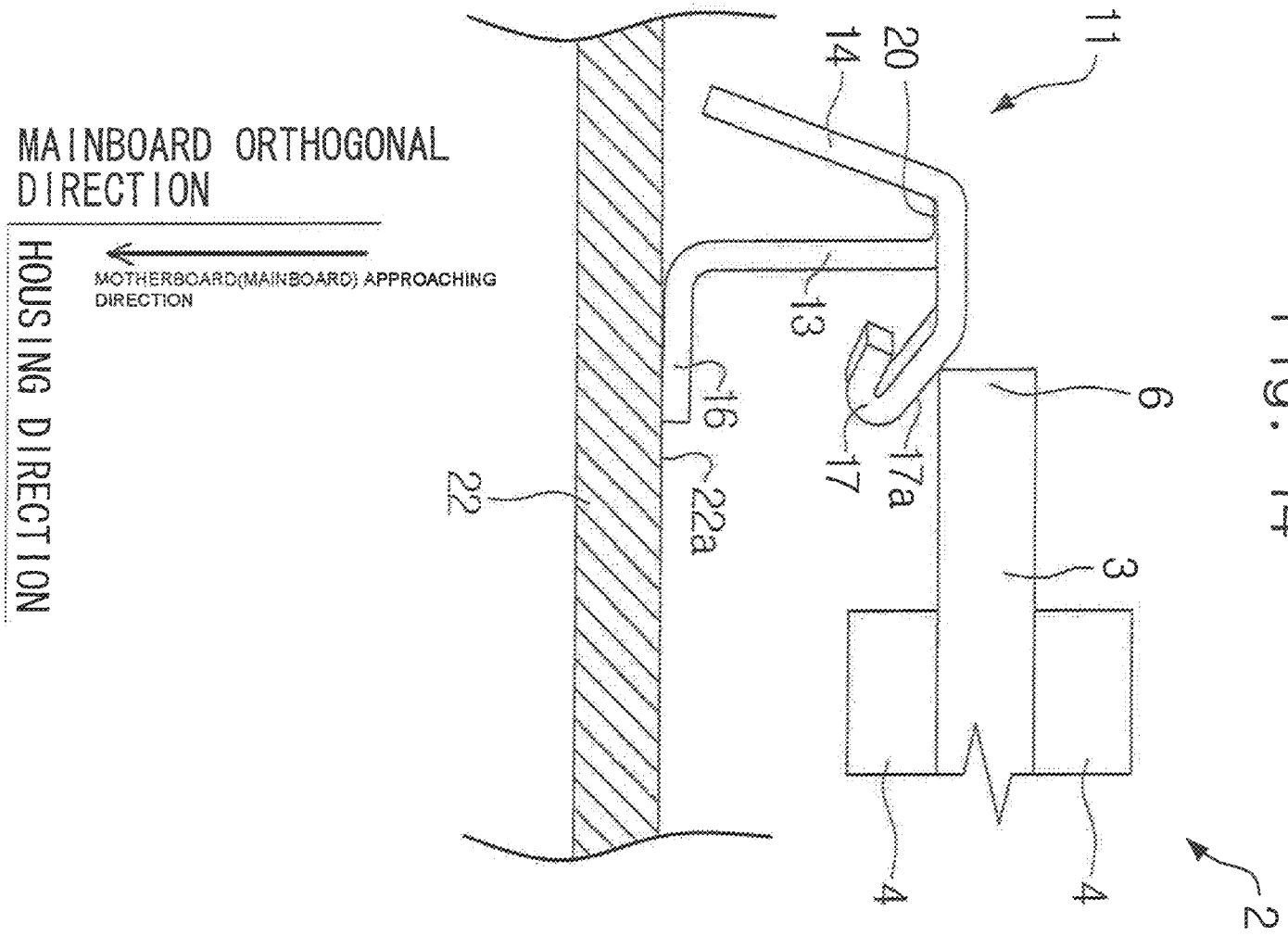
FIG. 14 is a diagram showing a state before the memory module is mounted (first exemplary embodiment)
Figure 15:
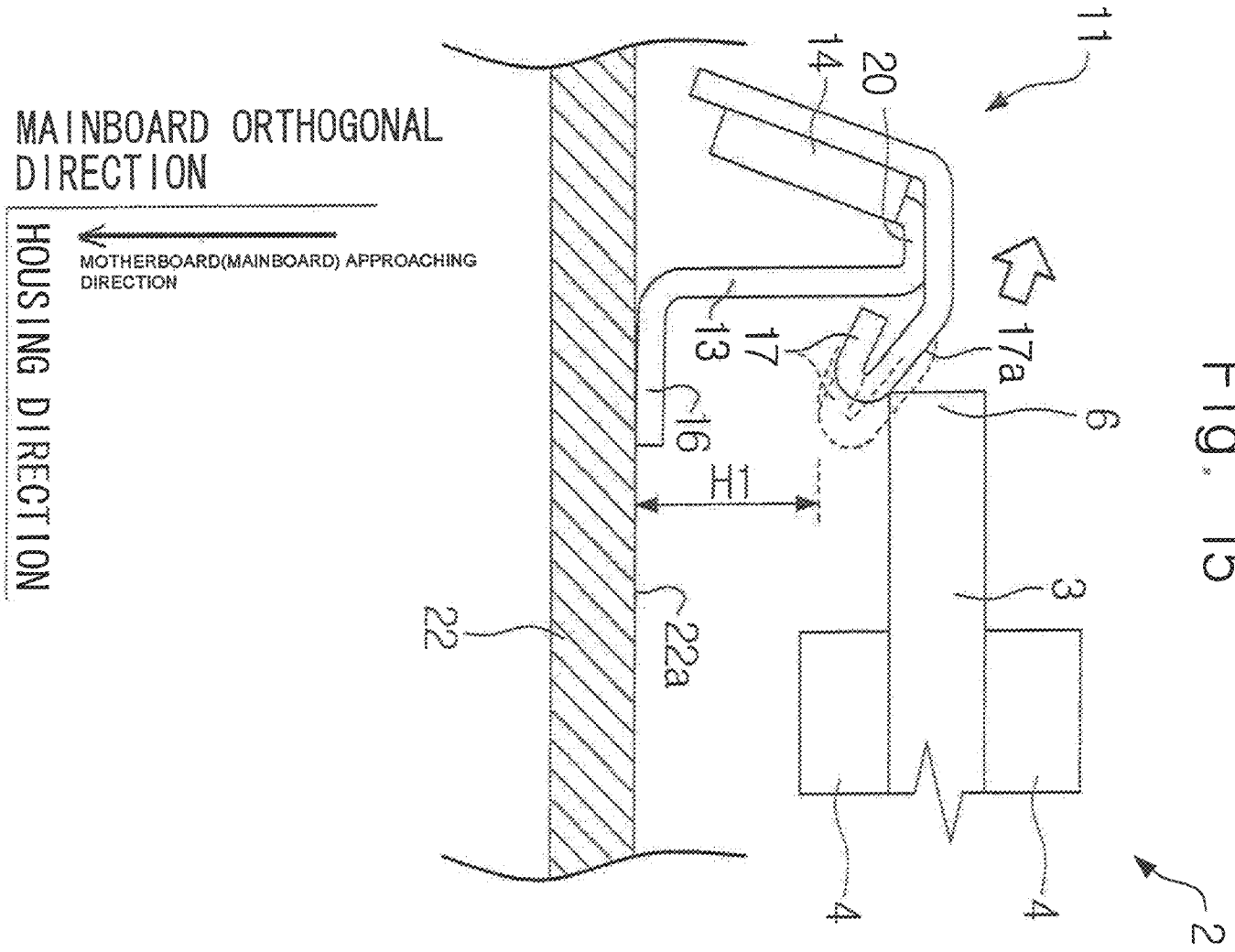
FIG. 15 is a diagram showing a displacement mode of the latch portion (first exemplary embodiment)
Figure 16:
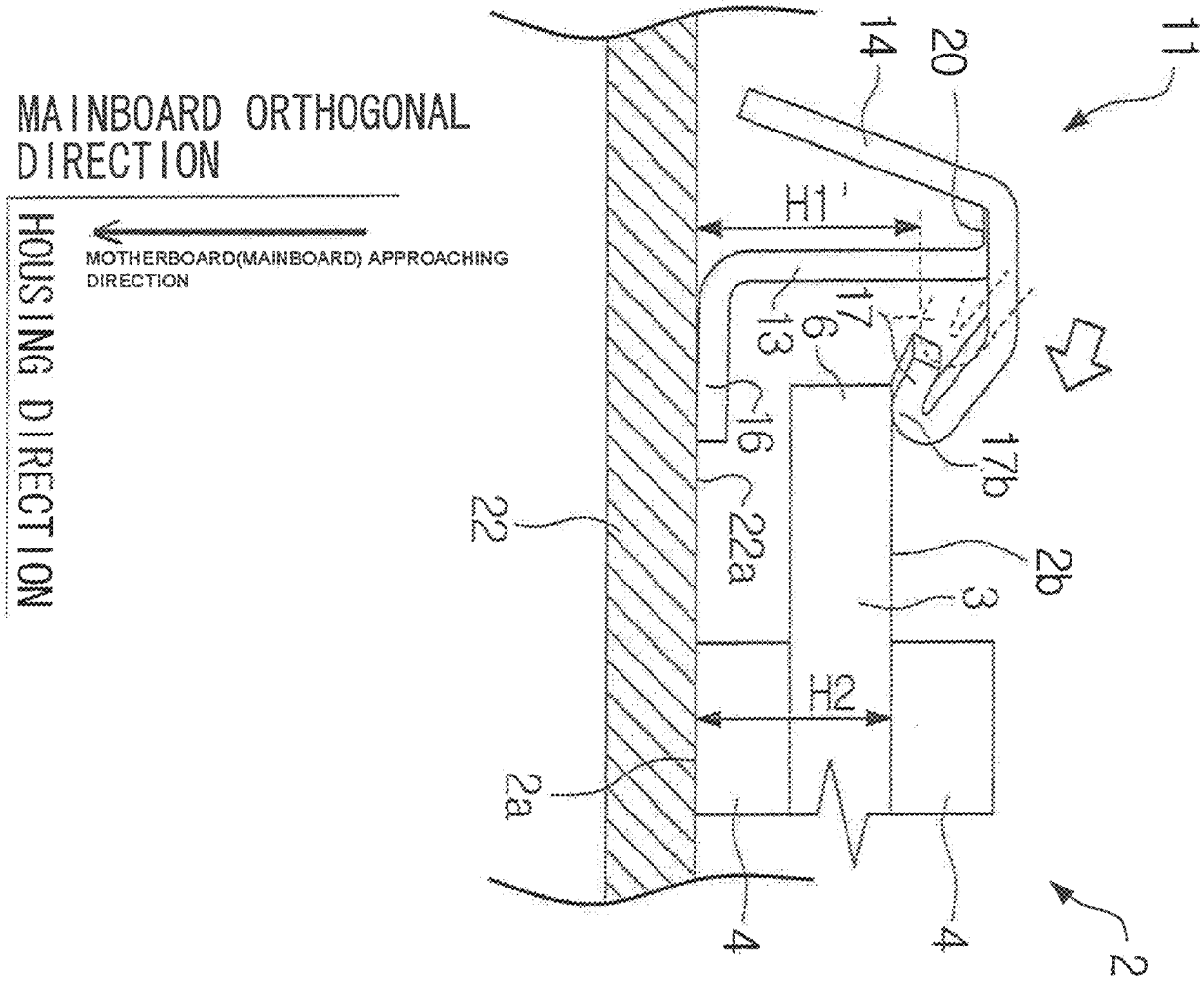
FIG. 16 is a diagram showing a mounted state of the memory module (first exemplary embodiment).

Referring next to FIGS. 14 to 16, the operation of the above-mentioned card edge connector 1 will be described.

FIG. 14 shows a state where a contact edge 5 of a memory module 2 is inserted into an insertion opening 12 of the housing 8 to depress the memory module 2 toward the mainboard 22, and a side edge 6 of a PCB 3 of the memory module 2 contacts a guide surface 17*a* of the latch portion 17 of the arm member 11.

As the memory module 2 is further depressed toward the mainboard 22 from the state shown in FIG. 14, the side edge 6 slides on the guide surface 17*a* and the side edge 6 pushes away the latch portion 17 in the obliquely upward direction, that is, in the housing anti-center direction and the mainboard separating direction, as indicated by the outline arrow in FIG. 15. In FIG. 15, the position before the displacement of the latch portion 17 is indicated by the dashed line for reference.

As the memory module 2 is further depressed toward the mainboard 22 from the state shown in FIG. 15, the side edge 6 further pushes away the latch portion 17 in the obliquely upward direction. Eventually, the side edge 6 overrides the latch portion 17, and as shown in FIG. 16, a module bottom surface 2*a* of the memory module 2 abuts against the connector mounting surface 22*a* of the mainboard 22. In FIG. 16, the position at the time of maximum displacement of the latch portion 17 is indicated by the dashed line for reference.

As is obvious from FIGS. 15 and 16, in this exemplary embodiment, when the latch portion 17 is pushed away in the housing anti-center direction by the memory module 2, the latch portion 17 is displaced in the direction away from the mainboard 22. Accordingly, a latch gap H1 before the displacement as indicated by the dashed line in FIG. 15 is directly referred to as the latch gap H1, and the latch gap H1 at the time of maximum displacement as indicated by the dashed line in FIG. 16 is referred to as a latch gap H1'. In this exemplary embodiment, the latch gap H1' is set to be greater than a module thickness H2, instead of setting the latch gap H1 to be greater than the module thickness H2. This allows the latch portion 17 to be restored in the housing center direction by the self elastic restoring force of the spring portion 14 so as to approach a pressed surface 2*b* of the memory module 2 from the obliquely upward direction, without physically interfering with the side edge 6 of the PCB 3 of the memory module 2 when the module bottom surface 2*a* of the memory module 2 abuts against the connector mounting surface 22*a* of the mainboard 22.

After that, when the depression of the memory module 2 toward the mainboard 22 is released, the memory module 2 is to spring up in the mainboard separating direction. However, as shown in FIG. 16, the pressed surface 2*b* of the memory module 2 contacts a pressing portion 17*b*, so that the displacement of the memory module 2 in the mainboard separating direction is regulated by the latch portion 17.

Here, the technical meaning of this exemplary embodiment will be described in more detail. As shown in FIG. 16, in this exemplary embodiment, "the latch gap H1' is greater than the module thickness H2" is a condition for allowing the latch portion 17 to be restored without any difficulty in the housing center direction by the self elastic restoring force of the spring portion 14, without physically interfering with the side edge 6 of the PCB 3 of the memory module 2 when the module bottom surface 2*a* of the memory module 2 abuts against the connector mounting surface 22*a* of the mainboard 22. Assuming herein that the latch gap H1 and the latch gap H1' satisfy the relation $H1' = H1 + \gamma$, for convenience of explanation, the above-mentioned condition "$H1' > H2$" can be rewritten into "$H1' = H1 + \gamma > H2$", and "$H1 > H2 - \gamma$" can be derived therefrom. As described above, the restoration condition is "$H1 > H2$" in Japanese Unexamined Patent Application Publication No. 2011-100647. As is obvious from the comparison with these conditions, the condition for the latch gap H1 in this exemplary embodiment is looser than that in Japanese Unexamined Patent Application Publication No. 2011-100647. In other words, the latch gap H1 in this exemplary embodiment can be reduced by $\gamma$ from the latch gap H1 in Japanese Unexamined Patent Application Publication No. 2011-100647. On the other hand, the latch gap H1 directly affects a gap $\alpha$ between the memory module 2 and the mainboard 22, and the gap $\alpha$ between the memory module 2 and the mainboard 22 decreases as the latch gap H1 decreases. For the reasons described above, it can be said that the gap $\alpha$ between the memory module 2 and the mainboard 22 is reduced in this exemplary embodiment, as compared to the case of Japanese Unexamined Patent Application Publication No. 2011-100647. Note that the reduction in the gap $\alpha$ between the memory module 2 and the mainboard 22 contributes to a reduction in height of a laptop personal computer according to this exemplary embodiment.

For reference, in the products associated with the inventors of this application, the above-mentioned $\gamma$ is about 200 microns. To put it briefly, when the card edge connector 1 of this exemplary embodiment is adopted in a laptop personal computer, a reduction in height of about 200 microns can be achieved.

An exemplary embodiment of the present invention has been described above. In summary, the above exemplary embodiment has the following features.

The card edge connector 1 is used to be mounted on the connector mounting surface 22*a* of the mainboard 22 to connect the memory module 2 (daughterboard) to the mainboard 22 (motherboard). The card edge connector 1 includes the latch portion 17 for pressing the memory module 2, which is to be displaced in the direction away from the connector mounting surface 22*a*, toward the connector mounting surface 22*a*, and the spring portion 14 (plate spring) for allowing the connector mounting surface 22*a* to elastically support the latch portion 17. The spring portion 14 is inclined with respect to the connector mounting surface 22*a*. According to the configuration described above, the latch portion 17 can be elastically displaced in the direction away from the connector mounting surface 22*a*. Accordingly, the gap α between the mainboard 22 and the memory module 2 in the state where the memory module 2 is connected to the mainboard 22 can be reduced as compared to the case where the latch portion 17 is elastically displaceable only in the direction parallel to the connector mounting surface 22*a* (for example, the configuration disclosed in Japanese Unexamined Patent Application Publication No. 2011-100647).

The latch portion 17 has the guide surface 17*a* (push-away surface) for allowing the memory module 2 to push away the latch portion 17 when the memory module 2 is depressed toward the connector mounting surface 22*a* and contacts the guide surface 17*a*. The spring portion 14 is inclined with respect to the connector mounting surface 22*a* so that the latch portion 17 can be elastically displaced in the direction away from the connector mounting surface 22*a* when the latch portion 17 is pushed away by the memory module 2 through the guide surface 17*a*.

The card edge connector 1 is used to be mounted on the connector mounting surface 22*a* of the mainboard 22 to connect the memory module 2 to the mainboard 22. The card edge connector 1 includes the latch portion 17 for pressing the memory module 2, which is to be displaced in the direction away from the connector mounting surface 22*a*, toward the connector mounting surface 22*a*. The latch portion 17 is configured to be elastically displaceable in the direction away from the connector mounting surface 22*a*. According to the configuration described above, the gap α between the mainboard 22 and the memory module 2 in the state where the memory module 2 is connected to the mainboard 22 can be reduced as compared to the case where the latch portion 17 is elastically displaceable only in the direction parallel to the connector mounting surface 22*a* (for example, the configuration disclosed in Japanese Unexamined Patent Application Publication No. 2011-100647).

The latch portion 17 has the guide surface 17*a* for allowing the memory module 2 to push away the latch portion 17 when the memory module 2 is depressed toward the connector mounting surface 22*a* and contacts the guide surface 17*a*. The latch portion 17 is elastically displaced in the direction away from the connector mounting surface 22*a* when the latch portion 17 is pushed away by the memory module 2 through the guide surface 17*a*. According to the configuration described above, the latch portion 17 can be elastically displaced in the direction away from the connector mounting surface 22*a* only by depressing the memory module 2 toward the connector mounting surface 22*a*, without requiring any special work.

The card edge connector 1 further includes the spring portion 14 for the connector mounting surface 22*a* to elastically support the latch portion 17. The posture of the spring portion 14 is set to be elastically displaced in the direction away from the connector mounting surface 22*a* when the latch portion 17 is pushed away by the memory module 2 through the guide surface 17*a*. Thus, by utilizing the anisotropy of deformability of the spring portion 14, the configuration in which the latch portion is elastically displaced in the direction away from the connector mounting surface 22*a* when the latch portion 17 is pushed away by the memory module 2 through the guide surface 17*a* can be achieved with simplicity.

The spring portion 14 is inclined with respect to the connector mounting surface 22*a*. That is, as shown in FIG. 13, an angle θ formed between a surface 14*a* on the side of the housing center direction of the spring portion 14 and the connector mounting surface 22*a* is less than 90 degrees. In this exemplary embodiment, θ≈70 degrees is set as shown in FIG. 13.

(Second Exemplary Embodiment)

Next, a second exemplary embodiment of the present invention will be described. Here, differences between this exemplary embodiment and the first exemplary embodiment are mainly described, and a repeated explanation is omitted as needed. The components corresponding to those of the first exemplary embodiment are denoted by the same reference numerals as a rule.

Figure 3:
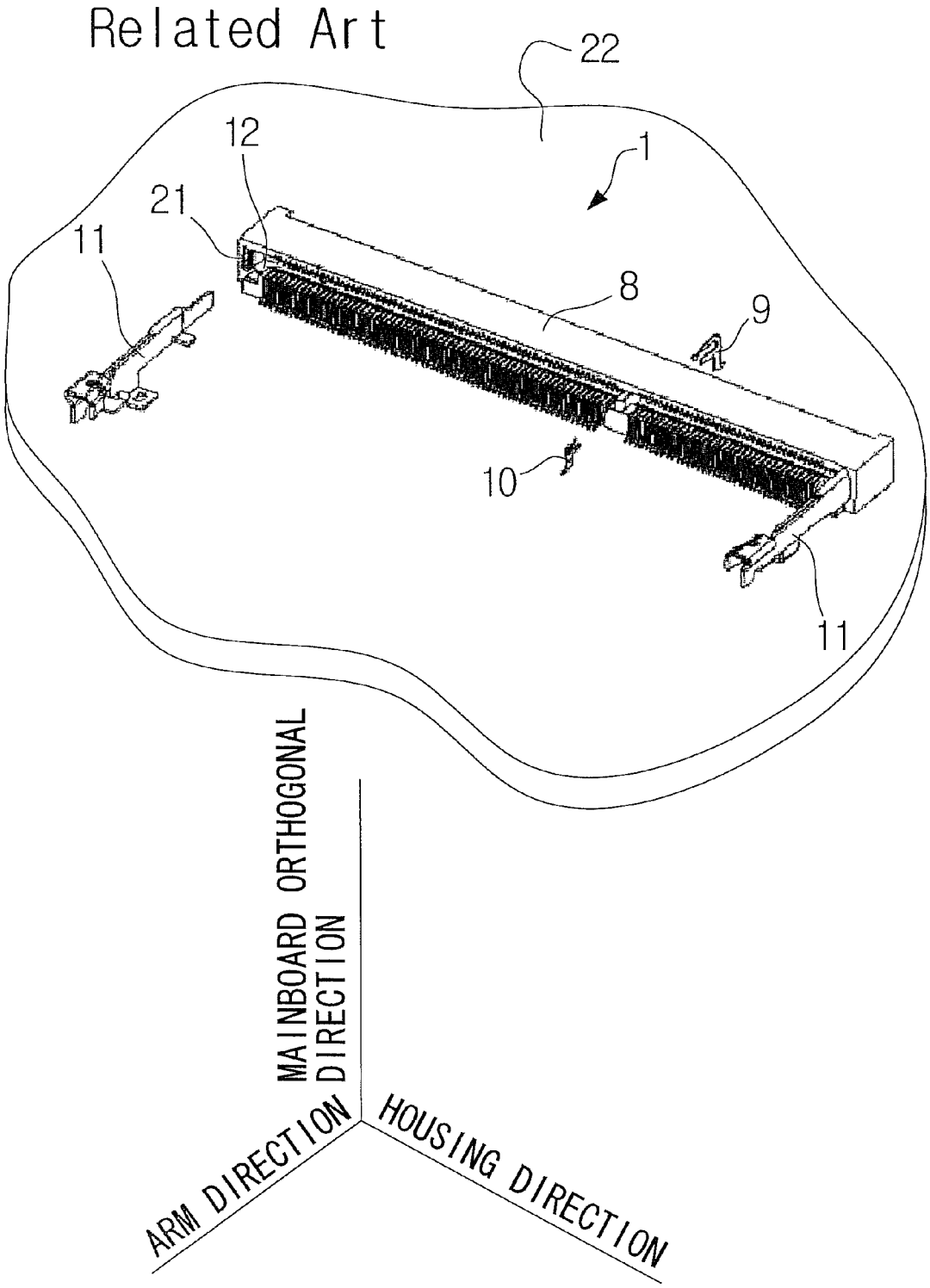
FIG. 3 is a diagram corresponding to FIG. 3 of Japanese Unexamined Patent Application Publication No. 2011-100647.
Figure 4:
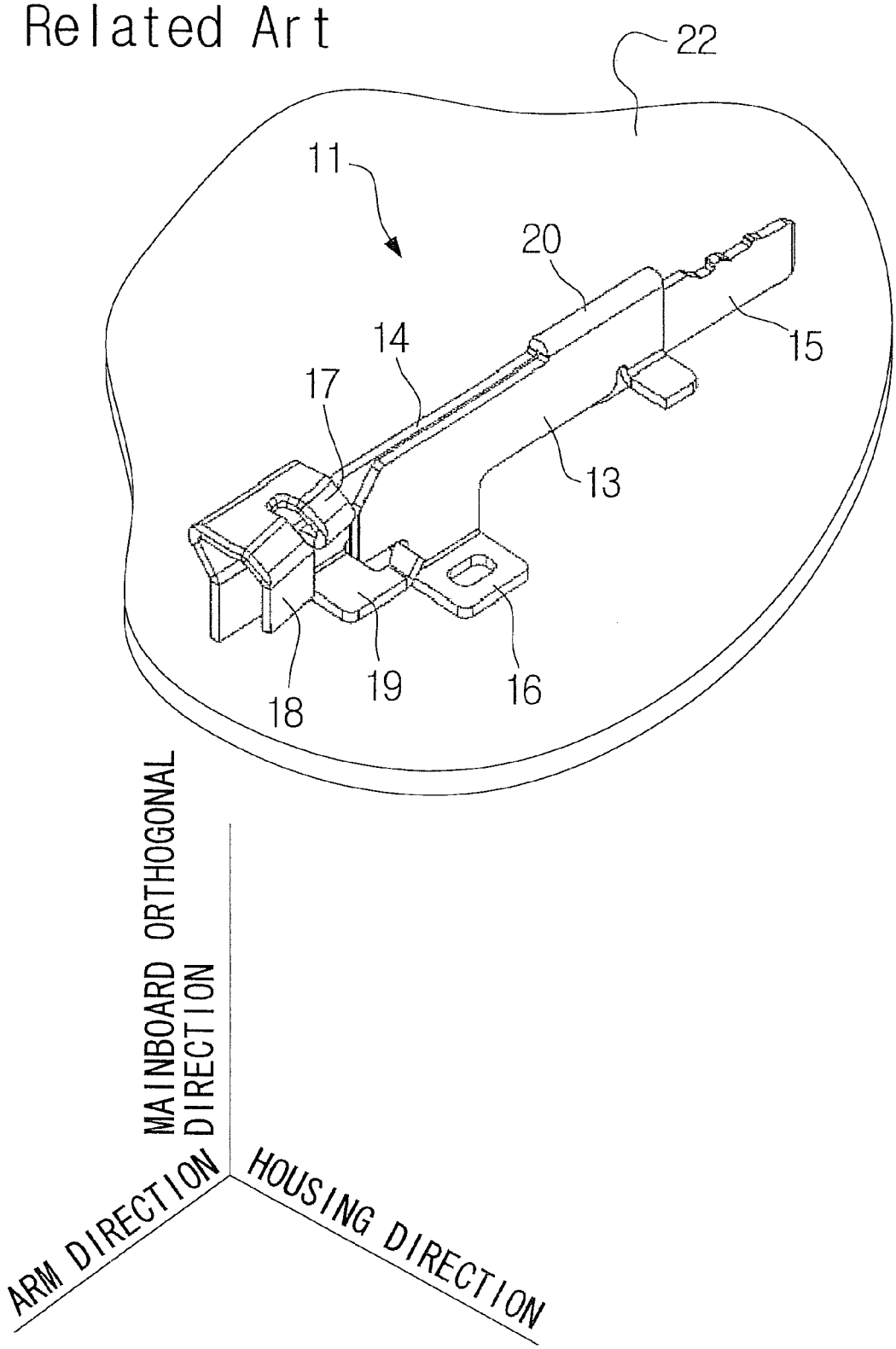
FIG. 4 is a diagram corresponding to FIG. 5 of Japanese Unexamined Patent Application Publication No. 2011-100647.
Figure 5:
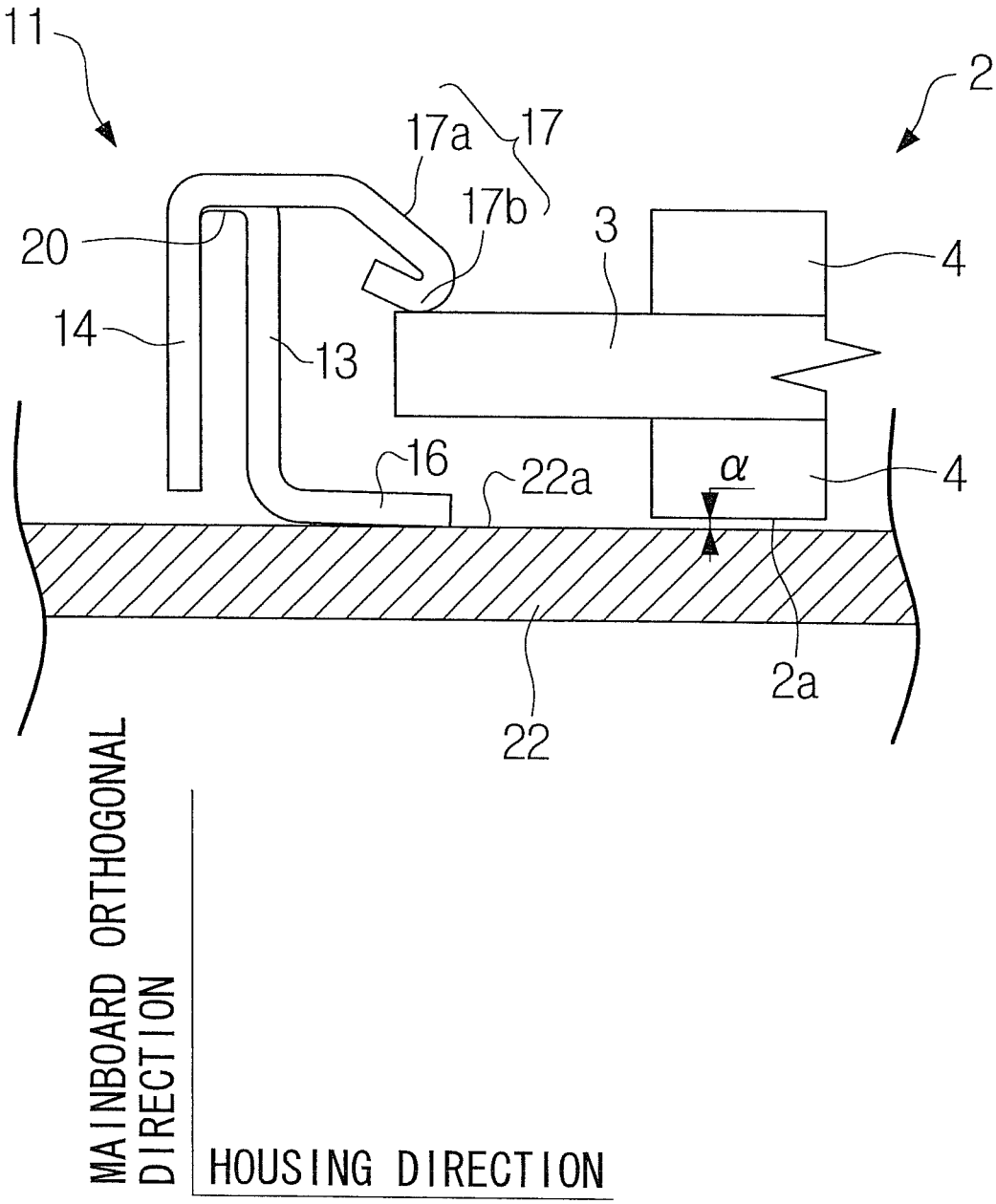
Fig. 5 Related Art
FIG. 5 is a diagram showing a mounted state of a memory module (comparative example)
Figure 6:
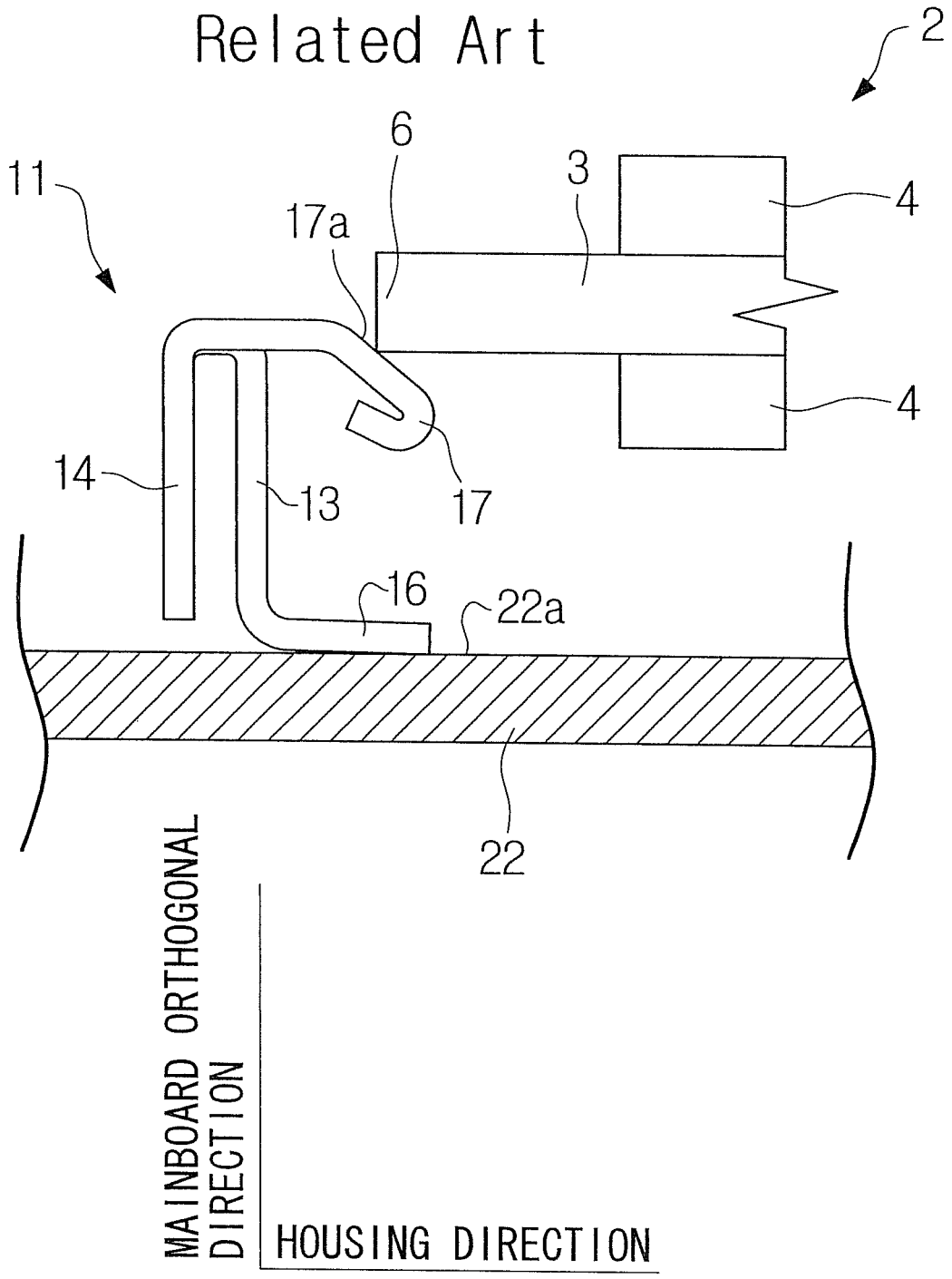
Fig. 6 Related Art
FIG. 6 is a diagram showing a state before the memory module is mounted (comparative example)
Figure 7:
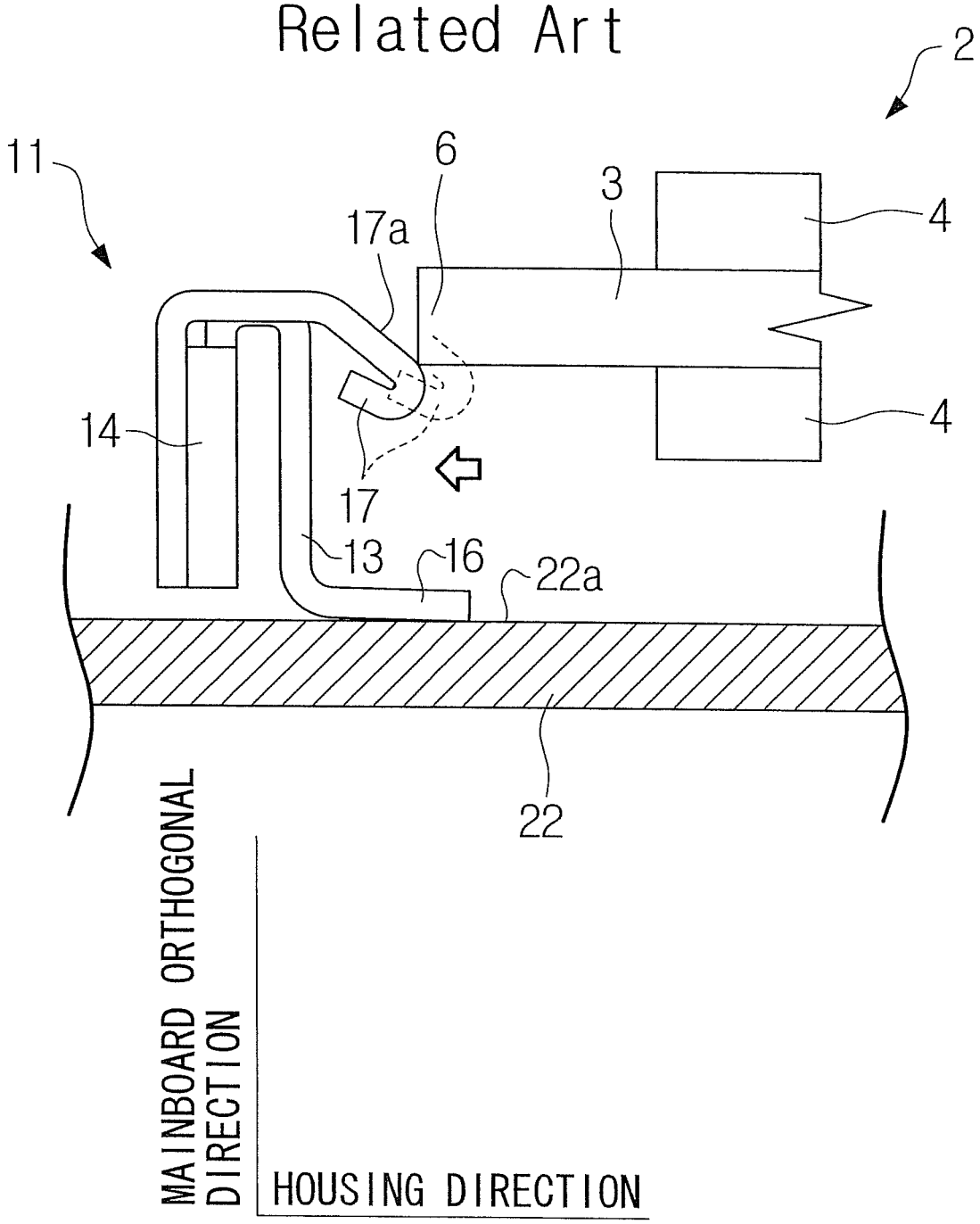
Fig. 7 Related Art
FIG. 7 is a diagram showing a displacement mode of a latch portion (comparative example)
Figure 8:
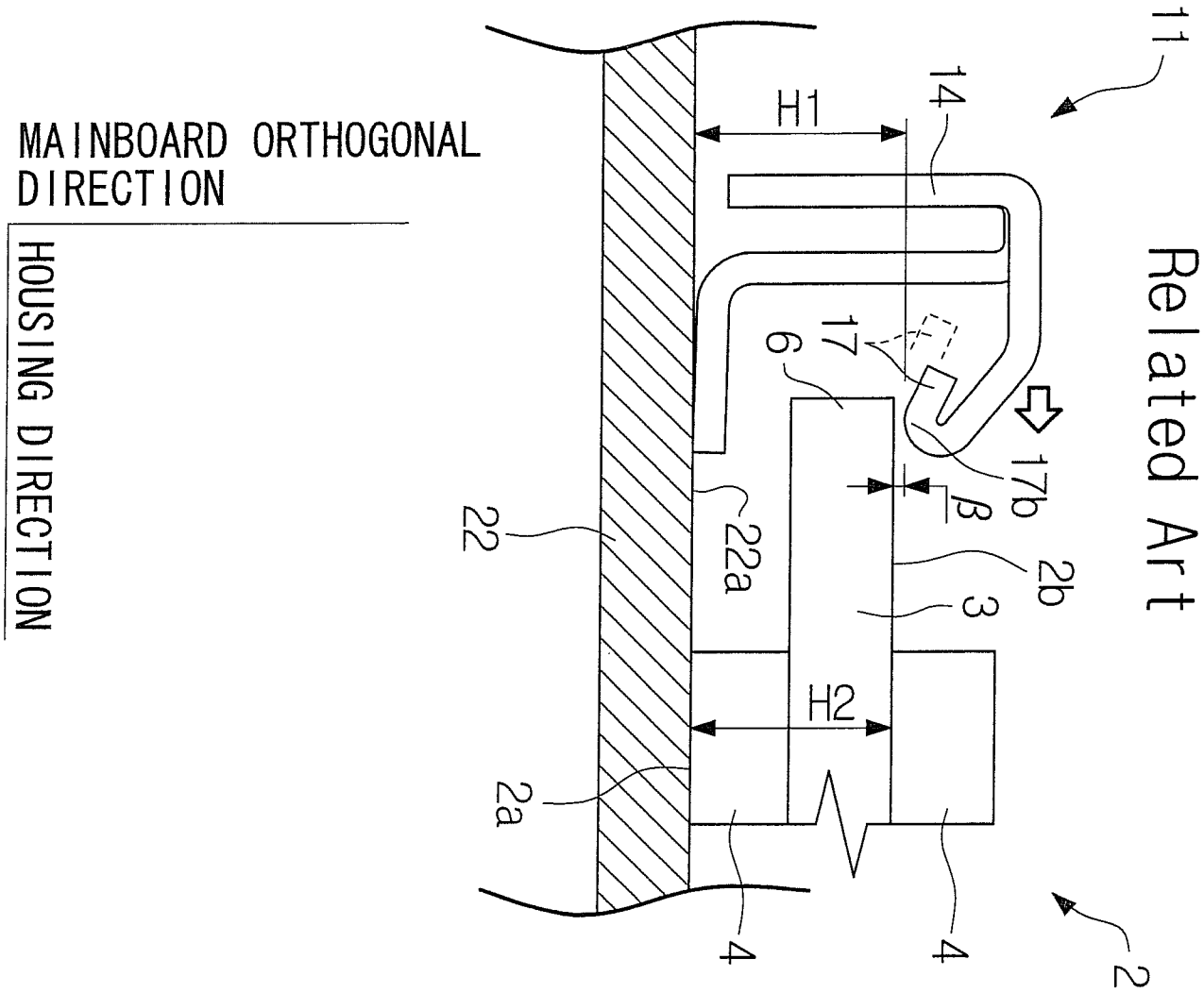
Fig. 8 Related Art
FIG. 8 is a diagram showing a state where the memory module is pressed against a mainboard (comparative example)
Figure 9:
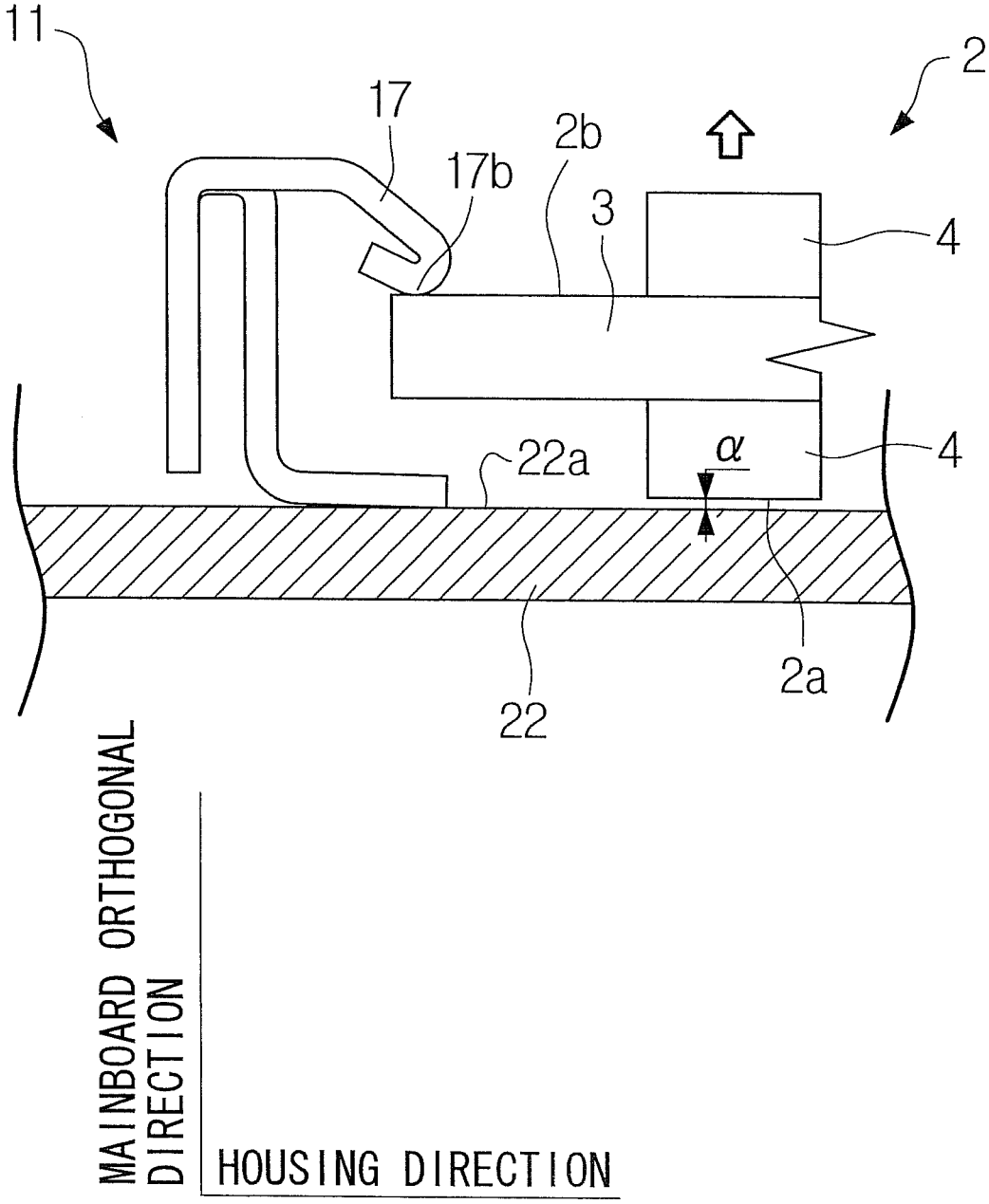
Fig. 9 Related Art
FIG. 9 is a diagram showing a mounted state of the memory module (comparative example)

In the first exemplary embodiment, the press-fitting portion 15 is press-fit in the mainboard approaching direction into the press-fitting hole 40 formed at each end in the housing direction of the housing 8 as shown in FIG. 10. Instead, in this exemplary embodiment, the press-fitting portion 15 is press-fit in the arm proximal direction into a press-fitting hole 21 formed at each end in the housing direction of the housing 8 as shown in FIG. 3.

(Third Exemplary Embodiment)

Next, a third exemplary embodiment of the present invention will be described. Here, differences between this exemplary embodiment and the first exemplary embodiment are mainly described, and a repeated explanation is omitted as needed. The components corresponding to those of the first exemplary embodiment are denoted by the same reference numerals as a rule.

In the first exemplary embodiment, the press-fitting portion 15 is press-fit in the mainboard approaching direction into the press-fitting hole 40 formed at each end in the housing direction of the housing 8 as shown in FIG. 10. However, in this exemplary embodiment, the press-fitting portion 15 is not press-fit but simply inserted in the mainboard approaching direction into the press-fitting hole 40 formed at each end in the housing direction of the housing 8. Also in this case, each arm member 11 can be strongly fixed to the mainboard 22 through the SMT portion 16 of the fixing portion 13.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A card edge connector configured to be mounted on a connector mounting surface of a motherboard to connect a daughterboard to the motherboard, the card edge connector comprising:

a housing formed in an elongated shape and having a central portion and opposed ends on either side of the central portion in a longitudinal direction of the housing; and an arm member disposed at one of the ends of the housing, wherein the arm member includes:

a fixing portion to be fixed to the connector mounting surface of the motherboard;

a plate spring coupled to the fixing portion; and a latch portion that is elastically supported by the plate spring and is arranged to press the daughterboard to be connected to the motherboard toward the connector mounting surface, the latch portion has a push-away surface that is configured to cause the daughterboard to push away the latch portion in an anti-center direction when the daughterboard is depressed toward the connector mounting surface and contacts the push-away surface, the anti-center direction being a direction extending away from the central portion of the housing and towards the ends of the housing in a longitudinal direction, and the plate spring is inclined in the anti-center direction and toward a motherboard approaching direction such that the latch portion will be elastically displaced not only in the anti-center direction but also in a direction away from the connector mounting surface when the latch portion is pushed away in the anti-center direction by the daughterboard through the push-away surface, the motherboard approaching direction being a direction approaching the motherboard.

2. A card edge connector configured to be mounted on a connector mounting surface of a motherboard to connect a daughterboard to the motherboard, the card edge connector comprising:

a housing formed in an elongated shape and having a central portion and opposed ends on either side of the central portion in a longitudinal direction of the housing; and a pair of arm members disposed at both ends of the housing, wherein each arm member includes:

a fixing portion to be fixed to the connector mounting surface of the motherboard;

a plate spring coupled to the fixing portion; and a latch portion that is elastically supported by the plate spring and is arranged to press the daughterboard to be connected to the motherboard toward the connector mounting surface, the latch portion has a push-away surface that is configured to cause the daughterboard to push away the latch portion in an anti-center direction when the daughterboard is depressed toward the connector mounting surface and contacts the push-away surface, the anti-center direction being a direction extending away from the central portion of the housing and towards the ends of the housing in a longitudinal direction, and the plate spring is inclined in the anti-center direction and toward the motherboard approaching direction such that the latch portion will be elastically displaced not only in the anti-center direction but also in a direction away from the connector mounting surface when the latch portion is pushed away in the anti-center direction by the daughterboard through the push-away surface, the motherboard approaching direction being a direction approaching the motherboard.

* * * * *